United States Patent [19]

Ramsay

[11] Patent Number: 4,824,334

[45] Date of Patent: Apr. 25, 1989

[54] MODULAR HYDRAULIC POWER SYSTEM

[76] Inventor: Ronald D. Ramsay, 1357 Hartnell Ave., #C, Redding, Calif. 96002

[21] Appl. No.: 115,711

[22] Filed: Nov. 2, 1987

[51] Int. Cl.[4] ..... F04B 49/00

[52] U.S. Cl. ..... 417/360; 417/423.15

[58] Field of Search ..... 417/360, 423 L, 423 T, 417/423 R; 60/458; 403/337

[56] References Cited

U.S. PATENT DOCUMENTS 2,250,306 7/1941 La Bour ..... 417/423 T 3,079,865 3/1963 Lipe et al. ..... 417/423 T 4,123,201 10/1978 Andriulis ..... 417/360 X

*Primary Examiner*—Leonard E. Smith

*Attorney, Agent, or Firm*—Flehr, Hohbach, Test, Albritton & Herbert

[57] ABSTRACT

A compact, yet versatile modular hydraulic power system is comprised of a center structure with an annular frame, a pump adapter for mounting a pump on the frame and a motor adapter for mounting a motor to the frame. The center structure is formed with a valve mount containing a manifold and a modular filter and relief valve units can be easily attached to this valve mount without requiring any external lines.

6 Claims, 1 Drawing Sheet

MODULAR HYDRAULIC POWER SYSTEM

BACKGROUND OF THE INVENTION

This invention relates to a modular hydraulic power system and more particularly to a compact modular adapting unit of a simple structure which can be assembled easily for supporting a hydraulic pump, a motor and accessory units such as a directional control valve.

To operate a given pump by a given motor, the user must initially check the mounting dimensions of the pump flange and the frame size of the motor and provide an appropriate adapter to couple them. Hydraulic pumps come in many sizes, however, and so do motors adapted to drive them. Thus, dealers are required to make available a large number of such adapters because a small motor may be mounted to a large pump or a large motor may be connected to a small pump, depending on the individual circumstances.

Utilizing currently available methods of adaption, the user has only a limited area within which he can operate when building or modifying units. The efficiency of constructing new units is now severely limited by the necessary use of many operations not readily automated and the narrow range of current adaption methods.

From the user's point of view, furthermore a new adapter must be purchased whenever it is decided to use a different motor on the same pump or to use the same motor to drive a different pump. In other words, the user must pay not only for a new motor or a new pump but also for an entirely new adapter.

In addition to a pump and a motor adapted to drive it, a hydraulic power system typically includes many accessory units such as, but not limited to, a directional control valve, heat exchanger, relief valve and, filter or filters, and various flow and pressure control valves. Conventional hydraulic power systems hitherto available commercially are structurally very complicated with many external lines and many man-hours are generally required to assemble such a system.

SUMMARY OF THE INVENTION

It is therefore an object of the present invention to provide a compact hydraulic power system of a simple structure which can be assembled easily.

It is another object of the present invention to provide a hydraulic power system having few external lines.

It is a further object of the present invention to provide a versatile and flexible hydraulic power system which can be used with different types of motors and pumps and can be connected to different accessory units.

To achieve the above and other objects, a compact, yet versatile modular hydraulic power system of the present invention is comprised of a center structure with an annular frame, a pump adapter for mounting a pump onto the frame and a motor adapter for mounting a motor to the frame. The center structure is formed with a valve mount containing the proper porting and manifolding to allow for easy attachment of relief valve, directional valve, filters, heat exchangers, and auxiliary valves to this valve mount without requiring any external lines.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
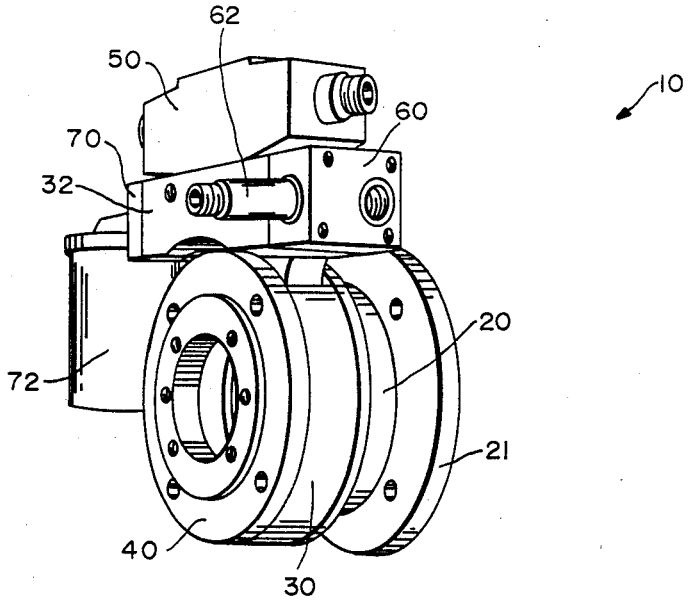
FIG. 1 is a perspective view of a modular hydraulic power system embodying the present invention.
Figure 2:
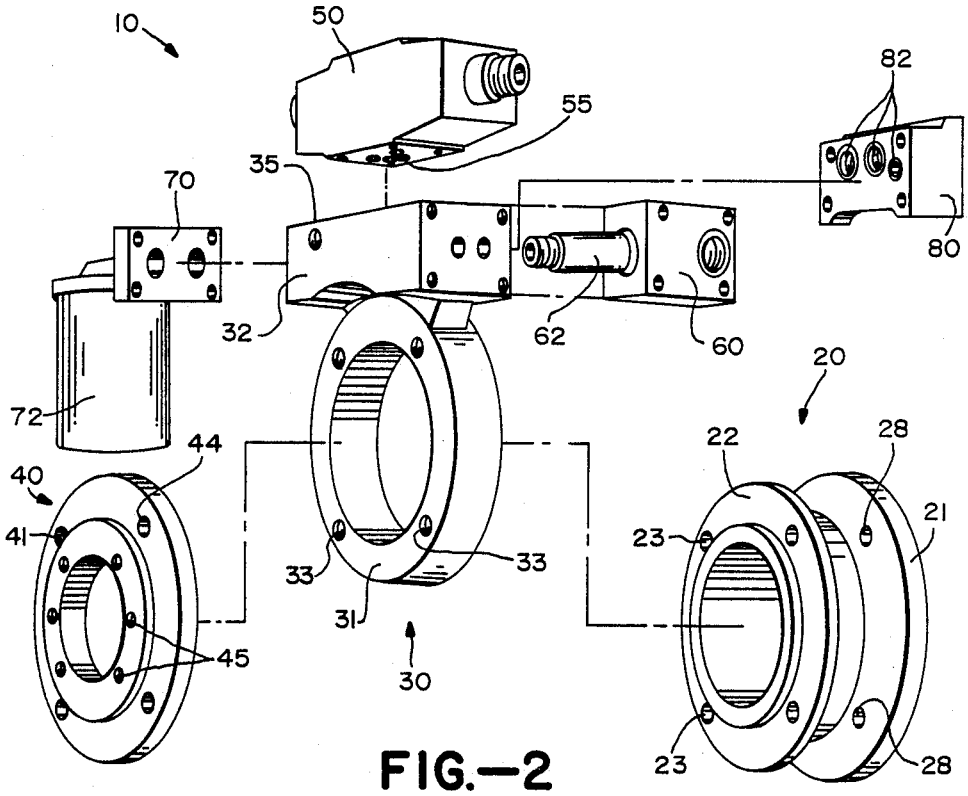
FIG. 2 is an exploded view of the modular hydraulic system of FIG. 1.

A modular hydraulic power system 10 embodying the present invention is shown in perspective in FIG. 1 and exploded view in FIG. 2.

With reference to these figures, numeral 20 indicates a motor adapter, numeral 30 indicates a center structure composed of an annular frame 31 and a valve mount 32 containing a manifold (not shown) with an arrangement of passageways and numeral 40 indicates a pump adapter. The motor adapter 20 is for the purpose of attaching a motor (not shown) to the frame 31 and is represented as a tubular piece with outer flange 21 to be attached to the motor and an inner flange 22 to be attached to the frame 31. The inner flange 22 and the annular surface of the frame 31 opposite thereto have four equally spaced, mutually corresponding bolt-accepting holes 23 through which bolts (not shown) are passed to fasten the motor adapter 20 to the frame 31. The outer flange 21 of the motor adapter 20 is affixed to the motor in a similar manner by means of bolts (not shown) which are passed through holes 28 provided to match the hole pattern on the frame of the motor to be attached.

The pump adapter 40 may be an annular disk as shown in FIG. 2 with four equally spaced holes 41. Bolts (not shown) are passed through these holes 41 as well as corresponding holes 33 on the surface of the frame 31 distal from the motor adapter 20 to fasten the pump adapter 40 on the frame 31. In addition, the pump adapter 40 is provided with a number of bolt-accepting holes 45 for accepting bolts for having a pump (not shown) attached to its surface. For the purpose of illustration, FIGS. 1 and 2 illustrate an adapter for mounting a pump flange of SAE-A designation with two or four holes but a different pump adapter for a different pump flange may be substituted, depending on the type of pump to be mounted.

The valve mount 32 is a block containing an arrangement of passages (not shown) with its top surface 35 provided with bolt-accepting holes and ports leading to the internal passages of the manifold. These bolt-accepting holes and the ports are arranged according to a standard pattern such as, but not limited to, D02 and D06 of the NFPA designations such that a directional control valve 50 having a matching surface pattern 55 can be connected to the manifold to control the direction of flow of liquid through the manifold.

Numeral 60 indicates a relief valve housing containing a cartridge 62 of a known kind for relieving or reducing pressure. Numeral 70 indicates a filter housing supporting a filter 72. These housings 60 and are removably attachable to mutually opposite side surfaces of the valve mount 32 by bolts (not shown) such that the fluid driven by the operation of the pump can be passed through the relief valve cartridge 62 into the manifold and also from the manifold through the filter 72 to a tank or whatever to which it is connected.

Numeral 80 indicates a manifold adapter which is formed with three holes 82 therethrough and is attachable by means of bolts (not shown) to one of the side surfaces of the valve mount 32. This surface of the valve mount 32 on which the adapter 80 is attached is also provided with openings which match these holes 82 through the adapter 80. On the opposite surface of the manifold adapter 80 are three ports (not shown) of different specifications such as different sizes and/or different threads such that components according to different specifications can be connected to the manifold.

Modular hydraulic power units of the present invention described generally above have many significant advantages. Firstly, a system of the present invention provides flexibility in the use of motors and pumps of different sizes as well as by different makers. Whenever a new motor or a new pump is to be substituted, the user has to replace only the motor adapter 20 or the pump adapter 40, which is only a very small part of the entire system from the point of view of cost. From the standpoint of a dealer, the number of components according to different specifications which should be made available to users is significantly reduced by the present invention. For example, the dealer may stock center structures with only a few different manifold types (with different bolt-hole and port patterns such as D02 and D06), pump adapters of only a small number of different types (corresponding, for example, to different SAE designations and different numbers of holes), and motor adapters of an equally small number of different types (corresponding to different NEMA specifications) but a very large number of different hydraulic power systems can be realized from such limited numbers of components. In addition, the dealer might make manifold adapters with different types of ports available such that each system can be made connectable to apparatus with a large variety of specifications.

Another advantage of the system according to the present invention is that additional components can be easily incorporated into the system. Although not shown in FIGS. 1 and 2 for the sake of simplicity, a heat exchanger in a modular form may be incorporated in the system, for example, between the filter housing 70 and the valve mount 32. Similarly, a pressure filter of a known kind but also in a modular form may be placed, for example, on the relief valve housing 60 or between the relief valve housing 60 and the valve mount 32. Compact, yet versatile systems tailored to the individual users' needs can thus be realized according to the present invention and assembly thereof can be accomplished with a minimum of time, skill and effort. Moreover, the modular design of the present invention mostly eliminates the external lines of conventional systems, further contributing to the compactness and safety of the system and ease with which it can be assembled.

The foregoing description of a preferred embodiment of the invention has been presented for purposes of illustration and description. It is not intended to be exhaustive or to limit the invention to the precise form disclosed, and many modifications and variations are possible in light of the above teaching. For example, although a pump adapter particularly designed for a pump flange of SAE-A designation with two or four holes is shown at 40 in FIGS. 1 and 2, it must be clear from the explanations given above that pump adapters designed for pump flanges of different designations, although not shown in the figures, may be substituted. In fact, the present invention is not limited to disk-shaped pump adapters. Pump adapters with two flanges, one to be attached to the pump flange and the other to the frame 31, are to be included within the scope of the present invention. It goes without saying that similar statements also apply to the motor adapter, the patterns on the top surface 35 of the valve mount 32, and the port pattern (not shown) on the manifold adapter 80. Such modifications and variations that may be apparent to a person skilled in the art are intended to be included within the scope of this invention.

What is claimed is:

1. A modular hydraulic power system comprising an annular frame, an annular motor adapter adapted to be removably attached to a motor and to said frame, and an annular pump adapter adapted to be removably attached to a pump and to said frame opposite said motor adapter, said annular frame including a valve mount, said valve mount containing a manifold with an arrangement of passages and having a mounting surface with ports and bolt-accepting holes formed thereon according to a standard pattern, said ports opening into said passages, and said mounting surface being adapted for attachment of a directional control valve.

2. The system of claim 1 wherein said valve mount and said annular frame are unistructurally formed.

3. The system of claim 1 wherein said standard pattern is one according to the NFPA designations.

4. The system of claim 1 further comprising a modular relief valve unit including a relief valve housing and a pressure relieving or reducing cartridge, said relief valve housing being removably attachable to said valve mount.

5. The system of claim 1 further comprising a modular filter unit including a filter housing and a filter, said filter housing being removably attachable to said valve mount.

6. The system of claim 1 further comprising a manifold adapter having a plurality of holes therethrough, each of said holes forming a port of a standard specification on one side and being connected on the other side to said manifold, said manifold adapter being adapted to be removably attachable to said valve mount.

* * * * *